US010465471B2

(12) United States Patent
Livescu et al.

(10) Patent No.: US 10,465,471 B2
(45) Date of Patent: Nov. 5, 2019

(54) TREATMENT METHODS FOR WATER OR GAS REDUCTION IN HYDROCARBON PRODUCTION WELLS

(71) Applicant: Baker Hughes, a GE company, LLC, Houston, TX (US)

(72) Inventors: Silviu Livescu, Calgary (CA); Jeyhun Najafov, Calgary (CA)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 146 days.

(21) Appl. No.: 15/643,622

(22) Filed: Jul. 7, 2017

(65) Prior Publication Data

US 2018/0010419 A1 Jan. 11, 2018

(51) Int. Cl.

| | |
|---|---|
| ***E21B 33/138*** | (2006.01) |
| ***E21B 29/02*** | (2006.01) |
| ***E21B 29/00*** | (2006.01) |
| ***E21B 47/06*** | (2012.01) |
| ***E21B 47/10*** | (2012.01) |
| ***E21B 47/00*** | (2012.01) |
| ***E21B 29/06*** | (2006.01) |
| *E21B 34/06* | (2006.01) |

(52) U.S. Cl.

CPC ..... *E21B 33/138* (2013.01); *E21B 29/002* (2013.01); *E21B 29/02* (2013.01); *E21B 29/06* (2013.01); *E21B 47/0002* (2013.01); *E21B 47/06* (2013.01); *E21B 47/065* (2013.01); *E21B 47/10* (2013.01); *E21B 34/066* (2013.01)

(58) Field of Classification Search

CPC .. E21B 47/0002; E21B 47/10; E21B 47/1005; E21B 47/101; E21B 47/1015; E21B 47/102; E21B 47/1025; E21B 33/138

USPC ..... 166/285, 281

See application file for complete search history.

(56) References Cited

U.S. PATENT DOCUMENTS

| | | | | |
|---|---|---|---|---|
| 6,041,860 | A * | 3/2000 | Nazzal | E21B 23/002 166/250.01 |
| 6,138,753 | A | 10/2000 | Mohaupt | |
| 7,428,921 | B2 | 9/2008 | Grove et al. | |
| 2003/0234106 | A1 | 12/2003 | Surjaatmadja | |
| 2007/0151766 | A1 | 7/2007 | Butler et al. | |
| 2008/0271925 | A1* | 11/2008 | Misselbrook | E21B 7/064 175/61 |
| 2010/0006292 | A1* | 1/2010 | Boles | E21B 43/26 166/305.1 |
| 2011/0024115 | A1* | 2/2011 | Brice | C04B 28/04 166/294 |
| 2015/0267500 | A1* | 9/2015 | Van Dongen | E21B 33/13 277/336 |

* cited by examiner

*Primary Examiner* — David Carroll
(74) *Attorney, Agent, or Firm* — Shawn Hunter

(57) ABSTRACT

Systems and methods for reducing unwanted water and/or gas intrusion into a hydrocarbon production wellbore. The system includes a treatment injection tool for injecting a treatment agent into portions of the formation surrounding the wellbore and a tunneling tool for forming one or more tunnels within the formation. Sensors provide real-time information about wellbore parameters during treatment so that wellbore analysis can be conducted.

14 Claims, 9 Drawing Sheets

TREATMENT METHODS FOR WATER OR GAS REDUCTION IN HYDROCARBON PRODUCTION WELLS

BACKGROUND OF THE INVENTION

1. Field of the Invention

The invention relates generally to systems and methods for treating a wellbore to reduce unwanted water and/or gas in hydrocarbon production fluid.

2. Description of the Related Art

In certain wells, hydrocarbon production may be reduced due to substantial permeability variation and heterogeneity, near-wellbore area damage, or water or gas coning or cusping.

SUMMARY OF THE INVENTION

The present invention relates to systems and methods for treating a wellbore to correct or reduce the amount of water or undesirable gas being produced in hydrocarbon production fluid. An exemplary arrangement is described which includes a treatment injection tool for injecting or applying a treatment gel or agent to a portion of the formation radially surrounding the wellbore. The treatment agent will block water/gas flow by filling perforations, pores and interstices within the formation. Treatment agents include polymer gels, resins and cement. The exemplary arrangement also includes a tunneling tool to create one or more lateral tunnels in the formation surrounding the wellbore. In certain embodiments, the tunneling tool is an acid injection tunneling tool. The tunneling tool may also be a lateral milling bottom hole assembly (BHA) which is run in separately from the treatment injection tool. An alternative embodiment is described wherein the treatment injection tool and the tunneling tool are incorporated into a single tool string.

In accordance with preferred embodiments, the treatment injection tool includes one or more sensors that are capable of detecting at least one downhole parameter, such as temperature, pressure, or gamma radiation. The one or more sensors might also include a camera which can obtain a visual image of the wellbore. Preferably, Telecoil® is used to allow the sensors to monitor the at least one downhole parameter in real-time during run-in, treatment and withdrawal of the treatment tool during operation. Information obtained by the sensors is then used in a wellbore analysis to help determine the causes of the water and/or gas within the hydrocarbon production fluid. Treatment methods are then adjusted in view of the analysis. Wellbore analysis may be conducted by a controller which is operably associated with the one or more sensors.

An alternative embodiment is described wherein the treatment tool and the tunneling tool are combined within a single tool string. Injection treatment is conducted along with wellbore analysis. Thereafter, the tunneling tool forms new tunnels within the formation surrounding the wellbore to promote improved hydrocarbon production flow.

BRIEF DESCRIPTION OF THE DRAWINGS

For a thorough understanding of the present invention, reference is made to the following detailed description of the preferred embodiments, taken in conjunction with the accompanying drawings, wherein like reference numerals designate like or similar elements throughout the several figures of the drawings and wherein.

DETAILED DESCRIPTION OF THE PREFERRED EMBODIMENTS

Figure 1:
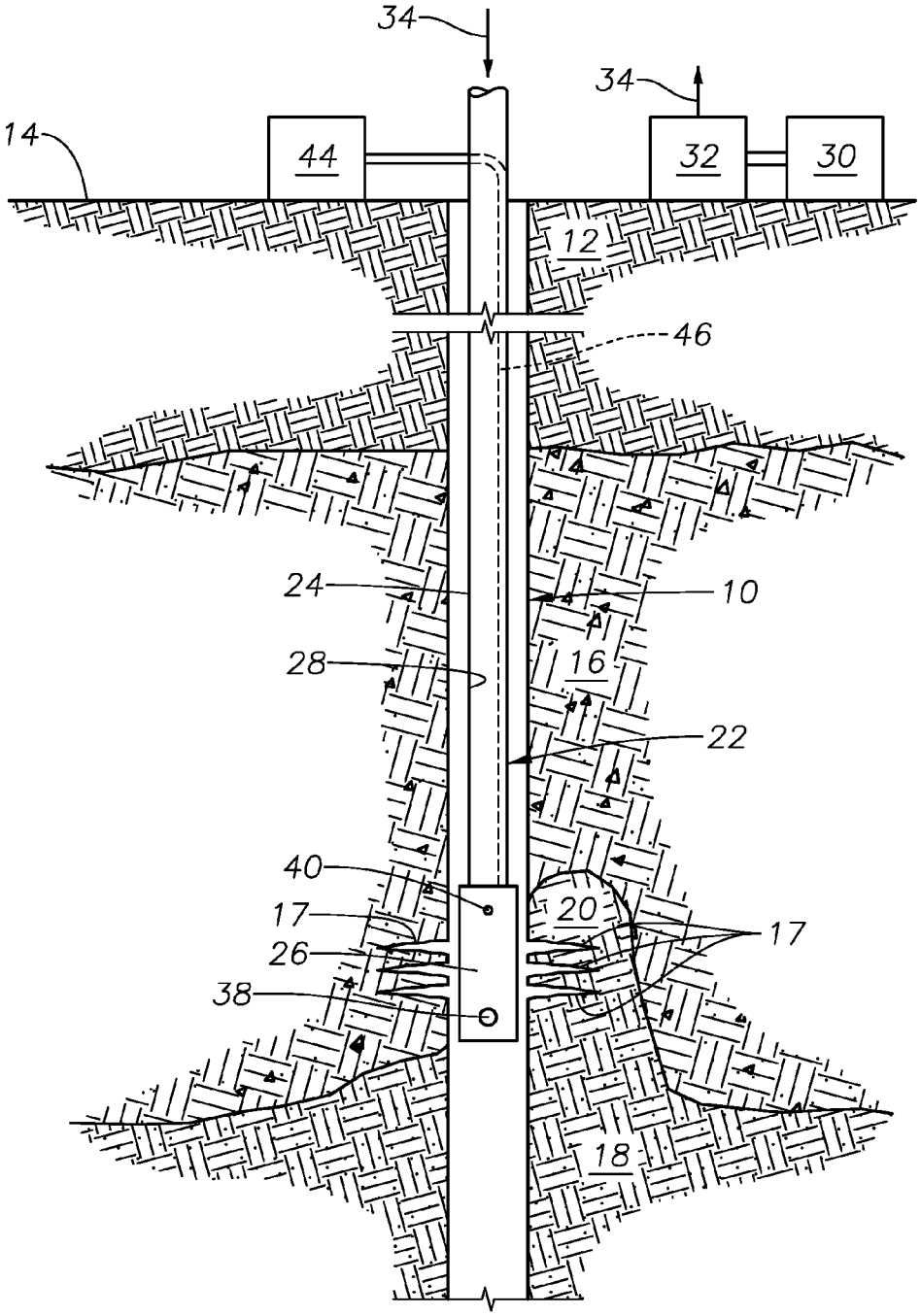
FIG. 1 is a side, cross-sectional view of an exemplary treatment injection tool arrangement in accordance with the present invention having been run into a wellbore to inject treatment agent.

The invention provides methods and arrangements for treatment of the formation surrounding a wellbore to reduce or eliminate unwanted water and/or gas in hydrocarbon production fluid to be produced from the wellbore. FIG. 1 depicts a wellbore 10 which has been drilled through the earth 12 from the surface 14 down to a hydrocarbon-bearing formation 16. Perforations 17 are shown which extend radially outwardly from the wellbore 10 into the formation 16. A layer 18 of water and/or gas lies at the lower portion of the formation 16. Water coning has affected the wellbore 10 as illustrated by the raised water level 20 proximate the wellbore 10 which afflicts the right side of the wellbore 10 with increased water/gas levels within the hydrocarbon production fluid that is produced by the wellbore 10. The wellbore 10 is depicted as being an uncased wellbore. It should be understood, however, that the wellbore 10 could also be a cased wellbore. The left side of the wellbore 10 is less affected by increased water/gas levels.

Figure 2:
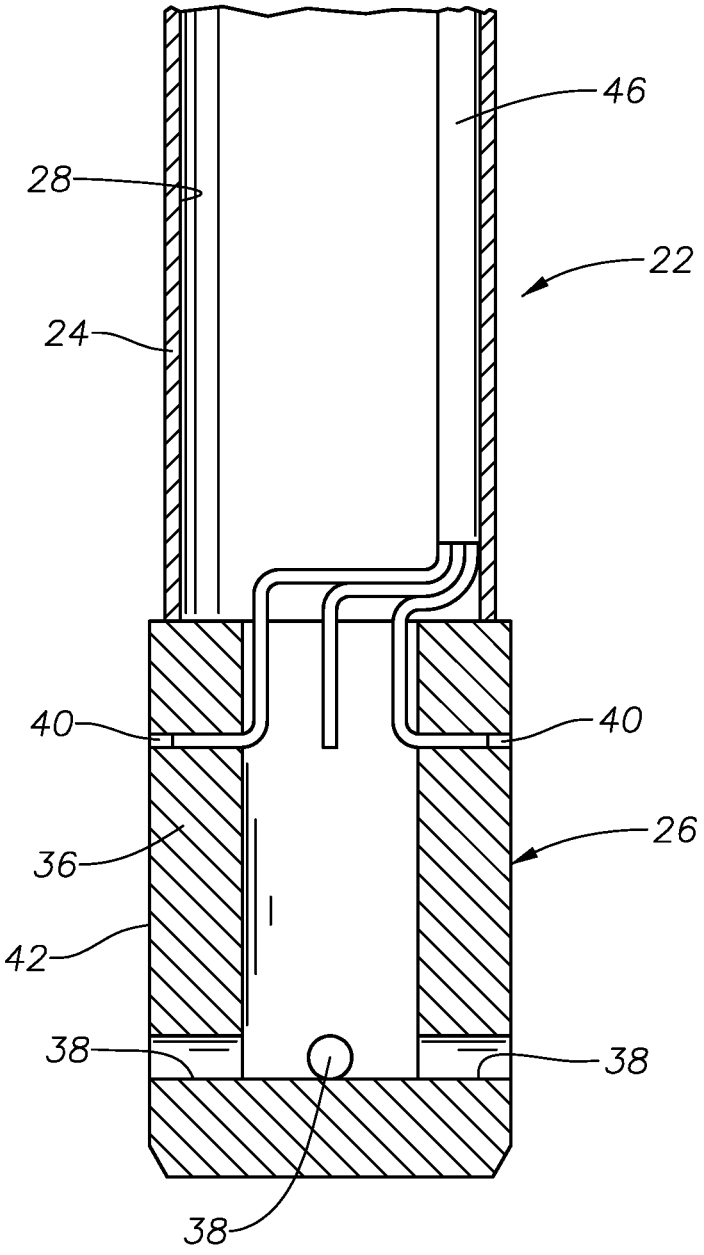
FIG. 2 is an enlarged side, cross-sectional view of an injection bottom hole assembly portion of the treatment injection tool of claim 1.

FIGS. 1 and 2 depict a treatment injection tool assembly 22 which has been run into wellbore 10 from the surface 14 by a coiled tubing injection assembly (not shown) of a type known in the art. The treatment injection tool assembly 22 includes a coiled tubing running string 24 which carries an injection bottom hole assembly 26. A flowbore 28 is defined along the length of the coiled tubing running string 24. A supply 30 of treatment agent is located at surface 14 and is operably associated with a fluid pump 32 which can flow treatment agent from the supply 30 through the flowbore 28 as indicated by arrows 34 in FIG. 1. The treatment agent is selected to be effective to block water flow through the formation 16 by filling pores and interstices within the formation 16 and portions of the perforations 17. Treatment agents can be one or more agents from a group which include polymer gels, resins and cement or other suitable treatment agents known in the art.

The injection bottom hole assembly 26 is used to inject a treatment agent into portions of the formation 16 radially surrounding the wellbore 10. The injection bottom hole assembly 26 is preferably a hydraulic tool that applies the treatment agent laterally. The depicted injection bottom hole assembly 26 includes a housing 36 having a plurality of lateral injection flow ports 38.

The treatment injection tool assembly 22 carries one or more sensors 40 that are operable to detect one or more downhole condition, including pressure, temperature, or gamma radiation. Sensors 40 are preferably disposed on, or proximate to, the radial exterior 42 of the injection bottom hole assembly 26. In preferred embodiments, the sensors 40 are electrically-powered transducers. Sensors that are useful for monitoring water inflow include sensors which measure pressure, temperature and pH. Additionally, the sensors 40 may include sensors which directly measure flow itself via production logging. Mathematical modeling conducted by the controller 44 could convert data obtained by the flow measurement sensor to information concerning fluid inflow from the formation 16. Power is preferably provided to the sensors 40 from a controller 44 at surface 14 (FIG. 1) which is also capable of supplying power via an electrical conduit combined with data cable. The controller 44 may be an electrical generator coupled with a programmable computer or logic circuitry which is programmed or configured with instructions and programming relating to water flow measurement. In preferred embodiments, the controller 44 includes a storage medium and display which permits an operator to graphically view information provided by the sensors 40. The data cable preferably transmits sensed information from the one or more sensors 40 to the controller 44. Preferably, Telecoil® is used to communicate power and data between the controller 44 at surface 14 and the sensors 40. Telecoil® is coiled tubing which incorporates at least one tube-wire that can transmit power and data. Tube-wire is a tube that contains an insulated cable that is used to provide electrical power and/or data to the injection bottom hole assembly 26 or to transmit data from the injection bottom hole assembly 26 to the controller 44. Tube-wire is available commercially from manufacturers such as Canada Tech Corporation of Calgary, Canada. In the depicted embodiment, tube-wire 46 extends from the sensors 40 to the controller 44. The sensors 40 provide real-time information of downhole conditions to an operator at surface 14.

In operation, the treatment injection tool assembly 22 is disposed into the wellbore 10 until the injection bottom hole assembly 26 is located proximate a location within the wellbore 10 wherein it is desired to inject treatment agent, as illustrated by FIG. 1. Pump 32 then flows treatment agent from the supply 30 through the flowbore 28 to the injection bottom hole assembly 26. Treatment agent flows out of the lateral injection flow ports 38. During injection of treatment agent, sensors 40 provide real-time information to the controller 44 at surface 14 as to pressure, temperature or other downhole conditions during injection. Downhole pressure, temperature and flow data could be collected along a section of the wellbore 10 that includes a perforation or point of interest for fluid inflow. Mathematical modeling can then be used to calculate the fluid inflow at that point of interest as well as determine the type(s) of fluid flowing into the wellbore 10 (i.e., gas, oil, water). Such mathematical modeling is described in greater detail in Livescu, S. and Wang, X., "Analytical Downhole Temperature Model for Coiled Tubing Operations," SPE Paper 168299 (2014) and Livescu, S. et al., "A Fully-Coupled Thermal Multiphase Wellbore Flow Model for Use in Reservoir Simulation," *Journal of Petroleum Science and Engineering* 71 (2010) 138-146. Information provided by the sensors 40 helps with location monitoring and changes of inflow/outflow. For an uncased wellbore, a gamma sensor could potentially match previous well lithology mapping to provide more accurate monitoring as compared to conventional techniques. In other words, the pressure and/or temperature would be different in front of a blocked perforation of if unwanted water or gas is flowing in from one perforation as compared to desired oil inflow. In the instance where at least one of the one or more sensors include a gamma sensor, reservoir lithology can be analyzed to determine the presence and amount of undesirable water and/or gas present. Gamma readings can be compared to a previous lithology log to convert into depth monitoring for open holes. Real fluid inflow and type(s) of fluid can be calculated based upon pressure and temperature data and potentially well flow data obtained via logging tools such as spinners. In the instant example, flow data analysis indicates excessive water entry from perforations 17 on the right hand side of the wellbore 10. As a result, an operator has filled perforations 17 on right side of the wellbore 10 with treatment agent, as indicated by the darkened portions of those perforations 17 in FIGS. 4-5.

Figure 3:
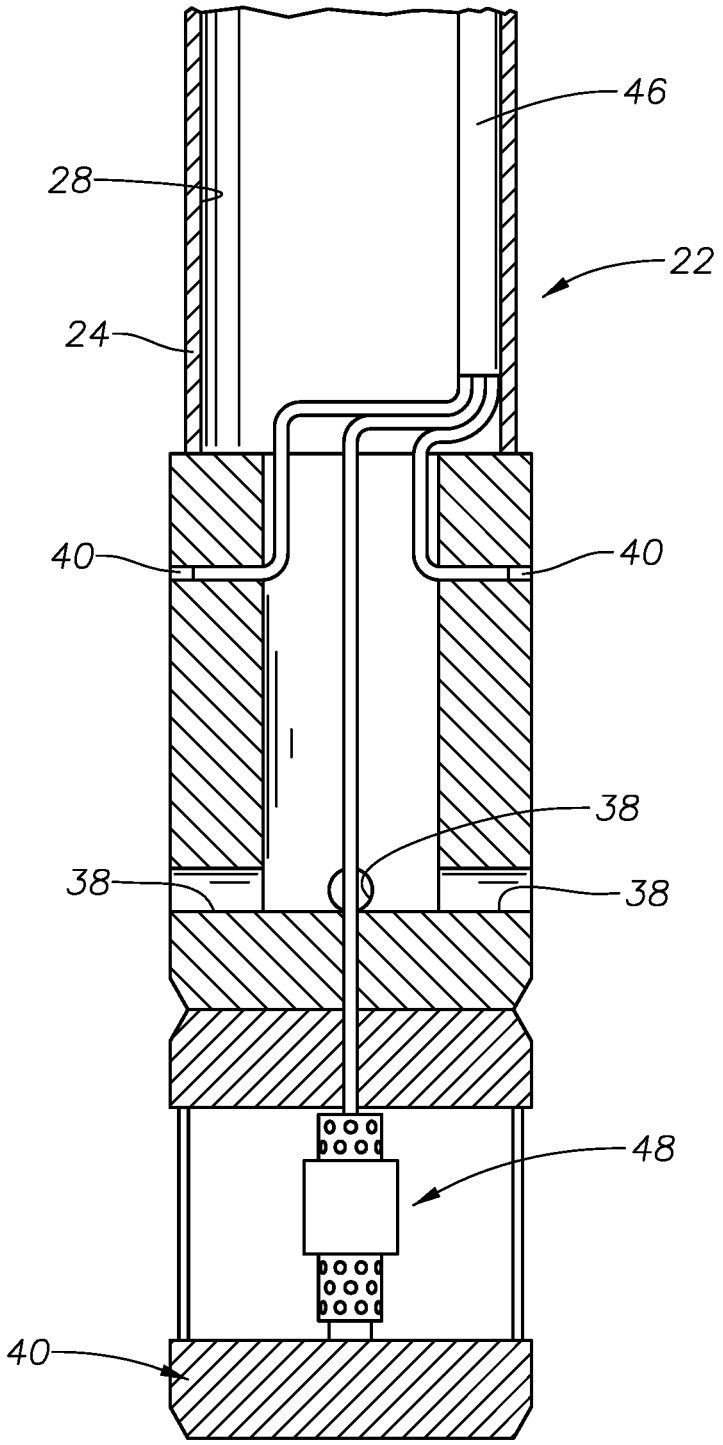
FIG. 3 is a side, cross-sectional view of an injection bottom hole assembly which incorporates a camera as a sensor.

FIG. 3 illustrates an alternative embodiment wherein the one or more sensors 40 include a side-viewing downhole camera 48 which is capable of obtaining visual images of the surrounding wellbore 10. A suitable downhole camera for use as the camera 48 is the Optis™ e-coil which is available commercially from the EV Company of Broussard, La.

Figure 4:
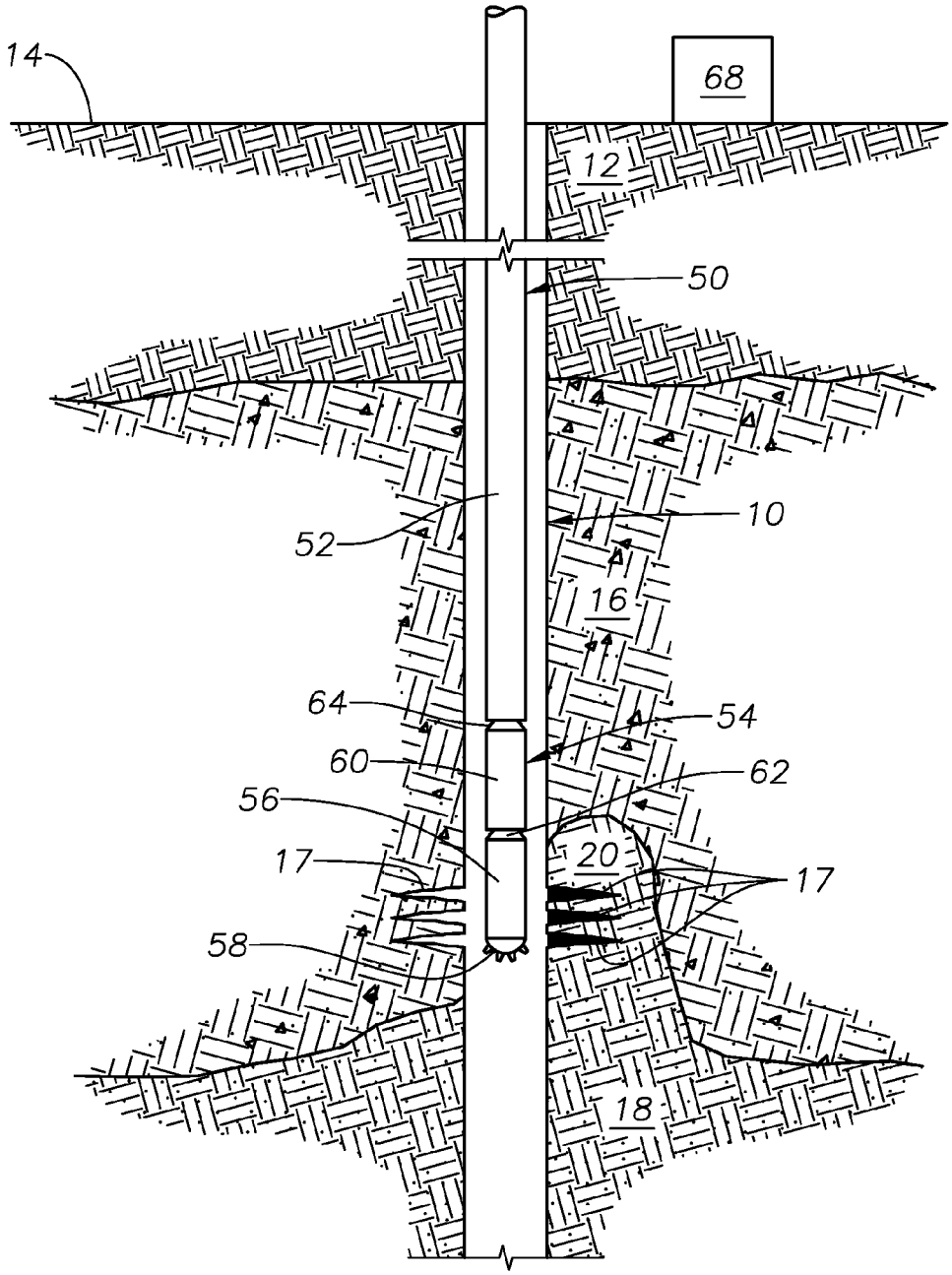
FIG. 4 is a side, cross-sectional view of an exemplary tunneling tool arrangement which is run into the wellbore to create one or more lateral tunnels in the formation surrounding the wellbore.
Figure 5:
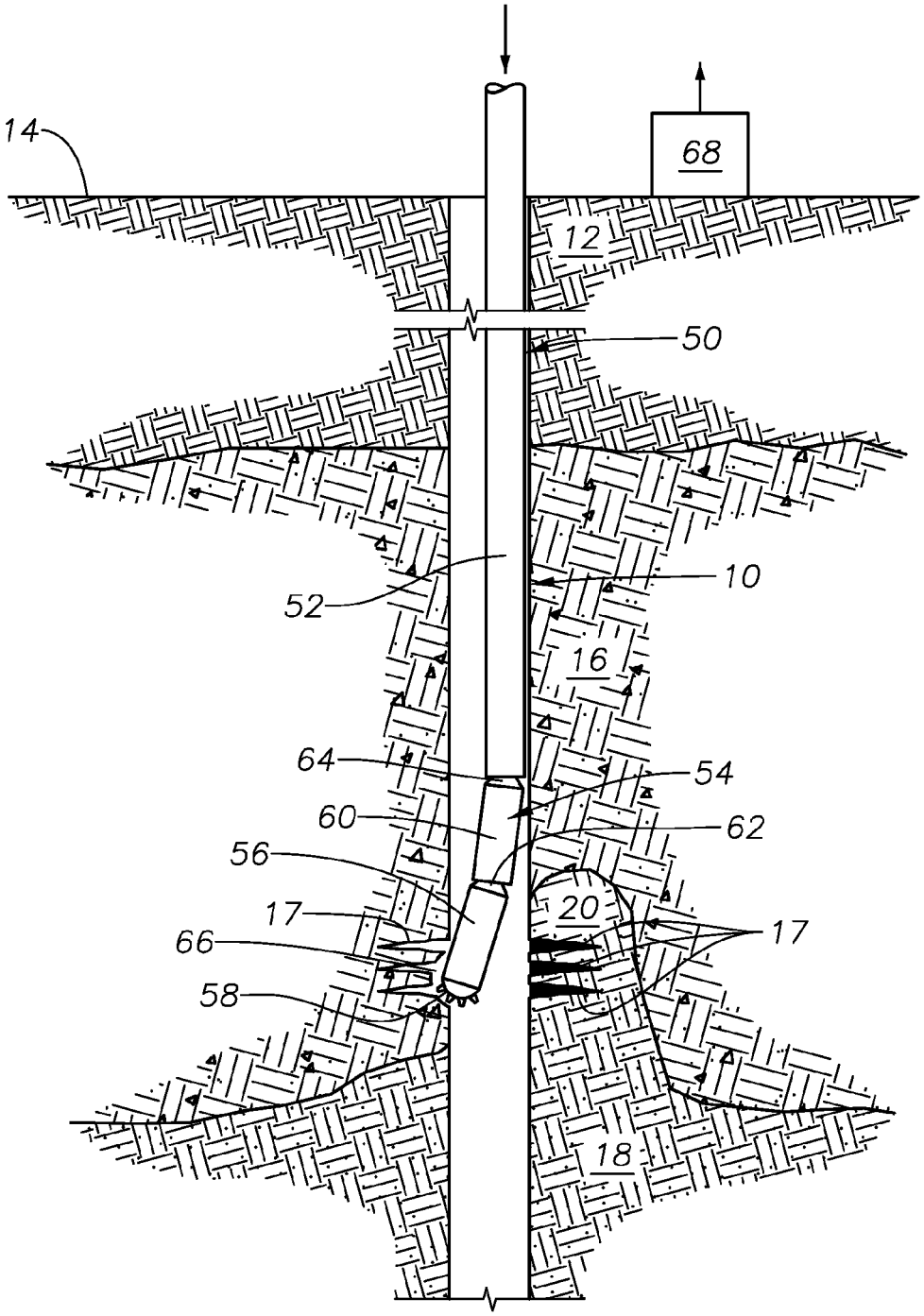
FIG. 5 is a side, cross-sectional view of the wellbore and tunneling tool of FIG. 4, now with the tunneling tool being actuated to create a tunnel within the formation.

FIGS. 4 and 5 depict an exemplary tunneling tool arrangement 50 which has been disposed within the wellbore 10 after the treatment injection tool assembly 22 has been withdrawn from the wellbore 10. The tunneling tool arrangement 50 includes a coiled tubing running string 52 which carries a tunneling tool 54. A suitable tunneling tool for use as the tunneling tool 54 is the StimTunnel acidizing tunneling tool which is available commercially from Baker Hughes Incorporated of Houston, Tex. The tunneling tool 54 includes a wand 56 with distal nozzle 58. The wand 56 is preferably affixed to an intermediate section 60 by an articulating joint 62 which permits the wand 62 to flex with respect to the intermediate section 60. The intermediate section 60 is preferably affixed to the running string 52 by an articulating joint 64. As depicted in FIG. 5, the intermediate section 60 and wand 56 will flex as acid is injected through the running string 52 and tunneling tool 54. This flexure permits directional application of acid within the formation 16 to form a tunnel 66 from which production fluid can enter the wellbore 10. In FIG. 5, a tunnel 66 is beginning to be formed on the left side of the wellbore 10. Because the left side of the wellbore 10 is not being subjected to excessive amounts of water due to water coning. A supply 68 of acid is located at surface 14 and is provided with suitable fluid pump injection equipment of a type known in the art to inject acid from the supply 68 down through the running string 76. At least one tunnel is formed within the formation 16 surrounding the wellbore 10 to promote flow of hydrocarbon fluid into the wellbore 10 from the formation 16. Because the at least one tunnel is being formed within a portion of the formation 16 that is less subject to or not subject to water coning, the hydrocarbon fluid flowing into the wellbore 10 will have reduced levels of undesirable water and/or gas.

Figure 5A:
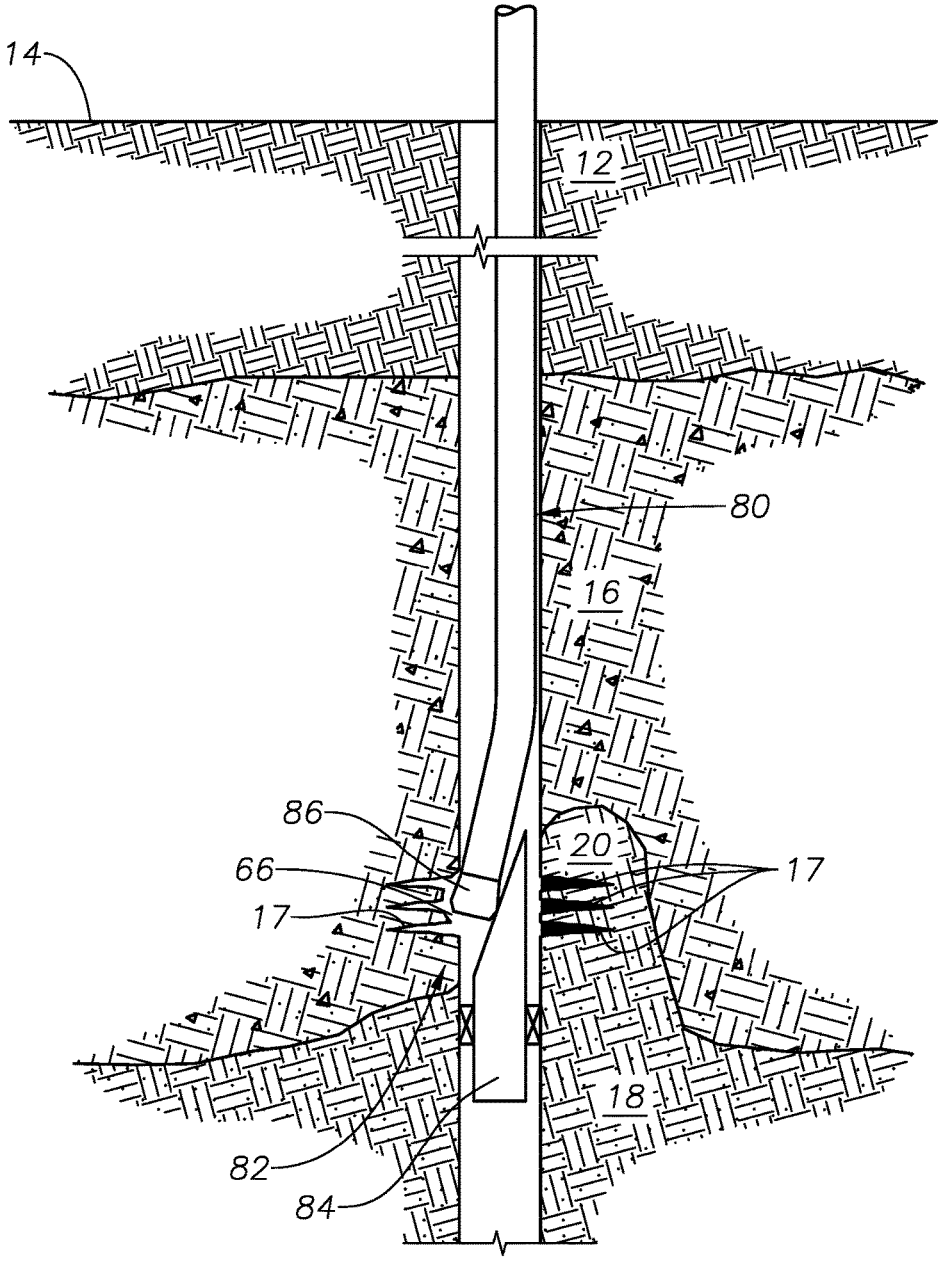
FIG. 5A is a side, cross-sectional view of a wellbore containing an alternative tunneling tool arrangement wherein the tunneling tool is a lateral milling tool.

FIG. 5A depicts an alternative tunneling tool arrangement 80 wherein the tunneling tool comprises a lateral milling tool 82. The lateral milling tool 82 is a sidetracking milling arrangement which includes a whipstock 84 which has been landed within the wellbore 10, and a sidetracking cutting mill 86. As is known, the whipstock 84 diverts rotary cutting mill 86 to cause it to form tunnel 66 when rotated.

Figure 8:
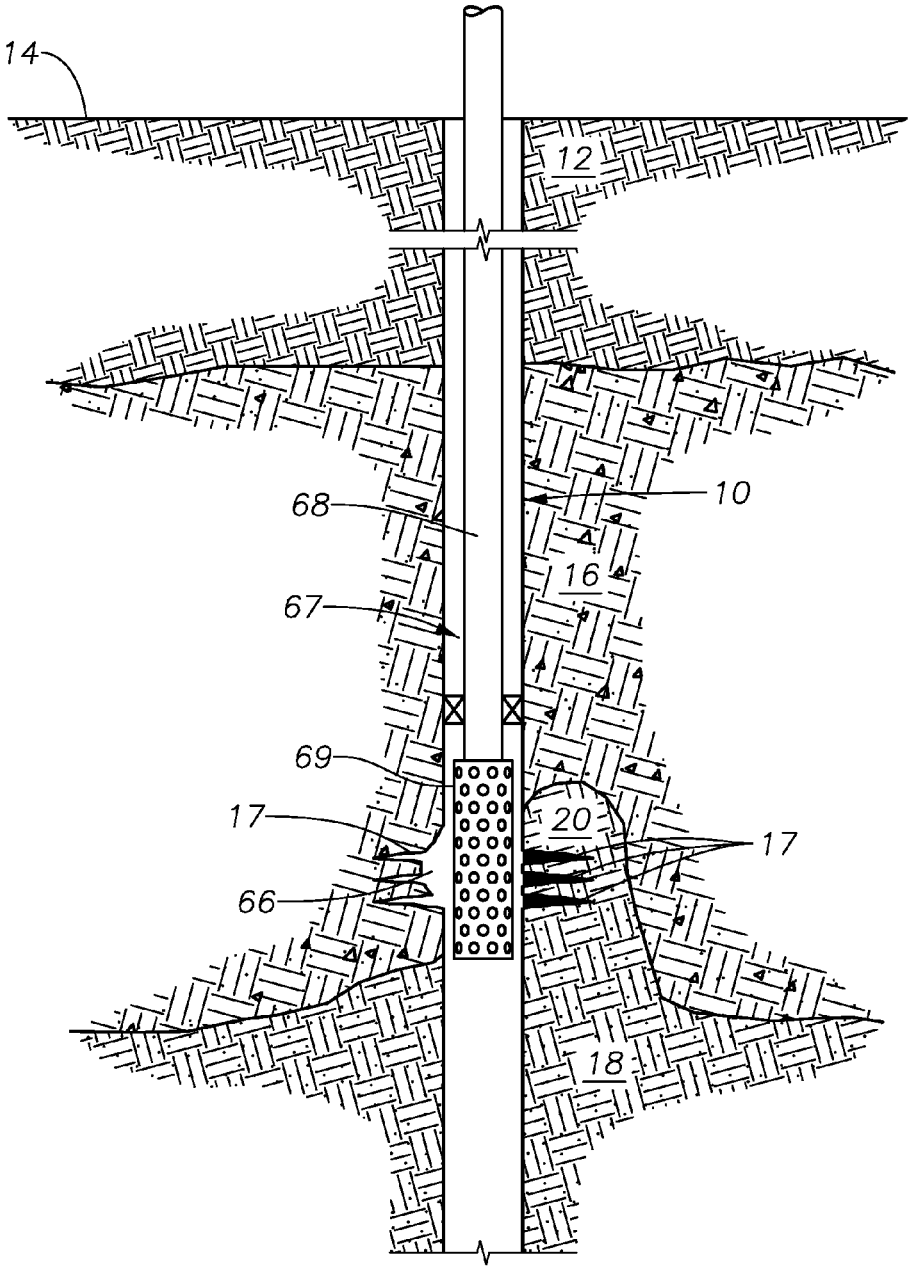
FIG. 8 is a side, cross-sectional view of a production arrangement for producing hydrocarbon production fluid from the wellbore.

After tunneling is completed, a production arrangement is run into the wellbore 10. FIG. 8 depicts a production string 67 which is made up of running string 68 and a production completion bottom hole assembly 69 which are useful for collecting production fluid and pumping it to surface 14. Because the construction and operation of such production strings are well understood, they are not described in any detail here. It is noted, however, that during production, flow from the formation 16 will primarily flow from the left side of the wellbore 10, including the tunnel 66 as well as left-side perforations 17. Flow from the right side of the wellbore 10 will be reduced with the overall result being production of fluid having lower levels of unwanted water and/or gas. It is further noted that the process of reducing unwanted water/gas in production fluid can be used with other wellbore configurations. For example, in the instance of a horizontal wellbore, perforations located at the lower side of the bore may be subject to water coning while perforations along the upper side of the bore are not or are less so. The systems and methods of the present invention may be employed to treat the lower side perforations to block flow therefrom and then use tunneling to increase flow from the upper side of the bore.

Figure 6:
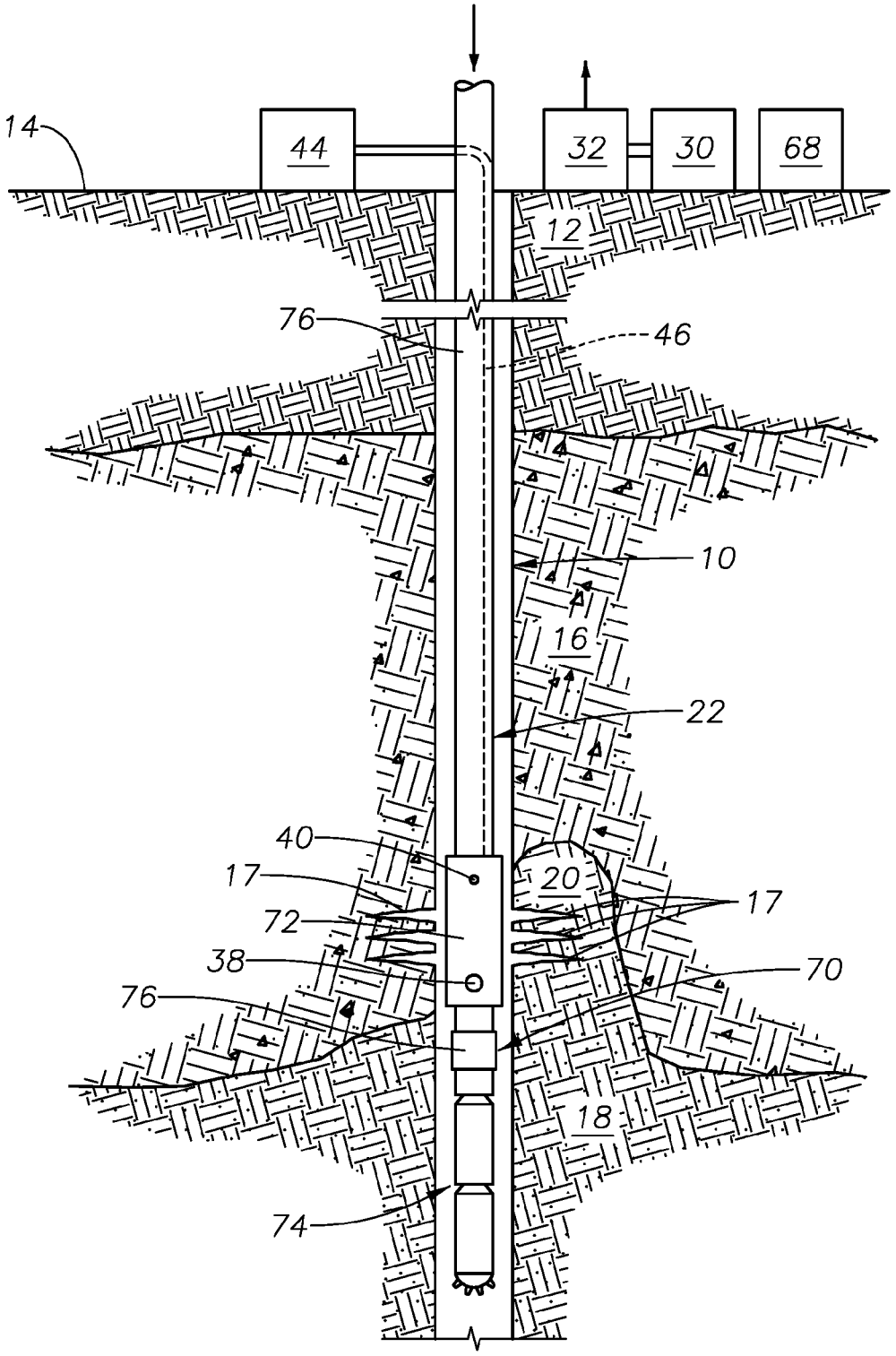
FIG. 6 is a side, cross-sectional view of a wellbore containing an exemplary combination treatment tool which includes a treatment injection tool and tunneling tool and which is configured to inject treatment agent.

In alternative embodiments, a tunneling tool is incorporated into the same tool string arrangement as the injection treatment assembly. FIG. 6 depicts an exemplary combination treatment tool arrangement 70 which includes a treatment injection tool 72 and a tunneling tool 74 which are carried by a single coiled tubing running string 76. The treatment injection tool 72 may be constructed and operate in the same manner as the injection bottom hole assembly 26 described earlier. The tunneling tool 74 may be constructed and operate in the same manner as the tunneling tool 54 described earlier. In particular embodiments, the combination treatment tool arrangement 70 includes a fluid flow valve 76 which is located between the treatment injection tool 72 and the tunneling tool 74. The valve 76 is operable to divert flow of fluids (which are pumped down the flowbore of the running string 76) between the treatment injection tool 72 and the to tunneling tool 74. Other flow control arrangements may be used as well to assist the proper flow of fluids. For example, the lateral flow ports 38 of the treatment injection tool 72 could be selectively closed as the valve 76 switches fluid flow from the treatment injection tool 72 to the tunneling tool 74. The valve 76 and other flow control arrangements may be operated using electrical power and commands from surface 14 via tubewire 46.

A number of surface-based components support the combination treatment tool 70. These include a supply of treatment agent 30 and fluid pump 32. In addition, a supply 68 of acid is located at surface 14 and is provided with suitable pumping or injection equipment as known in the art for injection into the running string 76. A controller 44 is also located at surface 14 and is operably associated with the tubewire 46 in order to perform the power, control and wellbore analysis functions described earlier.

In operation, the combination treatment tool 70 is disposed into the wellbore 10 until the treatment injection tool 72 is located proximate a selected location in the wellbore 10 wherein water coning is occurring (FIG. 6). The valve 76 is configured to allow fluid flow from surface 14 to the treatment injection tool 72 and not to the tunneling tool 74. Treatment agent is then flowed from supply 30 to the treatment injection tool 72 and into the formation 16. During injection of the treatment agent, data is provided by the sensors 40 to the controller 44 for purposes of wellbore analysis.

Figure 7:
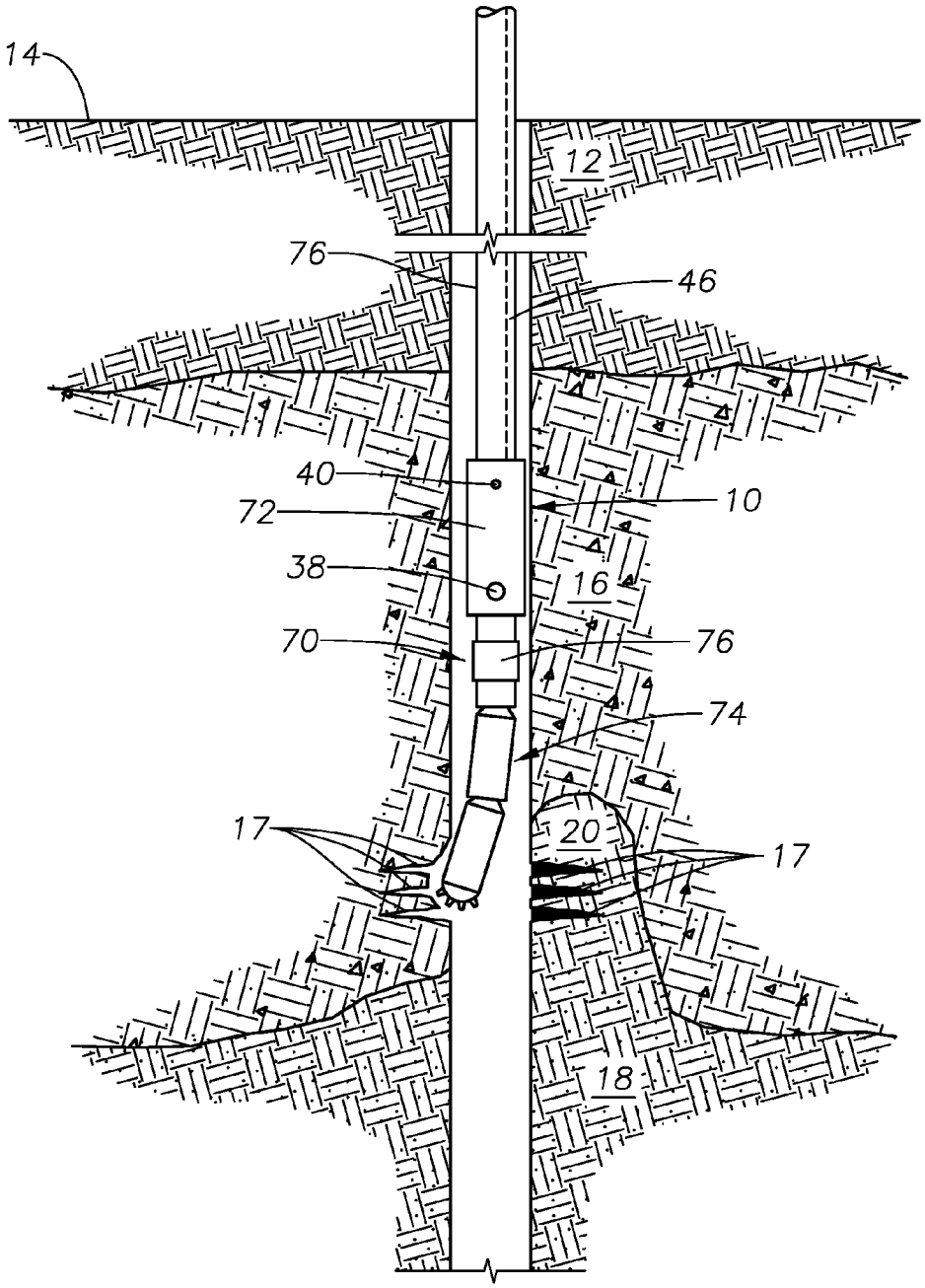
FIG. 7 is a side, cross-sectional view of the wellbore and combination treatment tool of FIG. 6, now configured to form a tunnel within the formation.

After treatment by injection of treatment agent, the running string 76 is then moved within the wellbore 10 so that the tunneling tool 74 is located proximate the selected location (FIG. 7). Valve 76 is actuated to allow fluid flow to the tunneling tool 74 and to prevent fluid flow to the treatment injection tool 72. Then acid from the acid supply 68 is flowed down through the running string 76 to the tunneling tool 74. Following tunneling and removal of the combination treatment tool arrangement 70, a production string 67 can then be disposed into the wellbore 10 to obtain production fluid.

The wellbore analysis allows wellbore fluid flow information to be determined based upon monitoring of one or more downhole parameters (i.e., pressure, temperature, pH, gamma or visual image of the wellbore 10 obtained by the camera 14). It is noted that wellbore analysis conducted based upon data collected during treatment can be used to improve or alter the treatment injection to be more effective. For example, certain perforations 17 within the formation 16 are closed off using injection of treatment agent to alter fluid flow into the wellbore 10 from the formation 16. Also, wellbore analysis could indicate locations wherein it would be productive to form a lateral tunnel 66 within the formation 16. The data collected can be used to subsequently make tunneling within the formation 16 more effective. In the illustrated example, excessive water entering from openings or perforations 17 on the right side of the wellbore 10 could be closed off and tunnels 66 then formed extending into the left side of the wellbore 10. Wellbore analysis calculations can be carried out by the controller 44 at surface 14 to determine flow characteristics relating to the wellbore 10.

Those of skill in the art will recognize that numerous modifications and changes may be made to the exemplary designs and embodiments described herein and that the invention is limited only by the claims that follow and any equivalents thereof.

What is claimed is:

1. An arrangement for reducing water and gas intrusion into a wellbore, the arrangement comprising:

a treatment injection tool for injecting a treatment agent into a formation radially surrounding the wellbore, the treatment agent being effective to block water and/or gas from entering the wellbore from the formation;

a tunneling tool for creating a tunnel in the formation; wherein the treatment injection tool and the tunneling tool are incorporated into a single tool string;

one or more sensors operably associated with the treatment injection tool to detect at least one downhole parameter within the wellbore during injection of treatment agent; and a valve which is operable to divert fluid flow between the treatment injection tool and the tunneling tool.

2. The arrangement of claim 1 further characterized by a controller which is operably interconnected with the one or more sensors, the controller being configured to receive and display information sensed by the sensors.

3. The arrangement of claim 2 wherein the controller is further programmed to determine wellbore fluid flow information based upon the detected at least one downhole parameter.

4. The arrangement of claim 2 wherein the controller is operably interconnected with the one or more sensors by a tubewire which can transmit power and data between the controller and the one or more sensors.

5. The arrangement of claim 1 wherein the one or more sensors include at least one sensor from the group consisting of: a pressure sensor, a temperature sensor, a gamma sensor, a flow measurement sensor and a camera.

6. The arrangement of claim 1 wherein the tunneling tool comprises an acid injection tunneling tool.

7. The arrangement of claim 1 wherein the tunneling tool comprises a lateral milling tool.

8. An arrangement for reducing water and gas intrusion into a wellbore, the arrangement comprising:

a treatment injection tool for injecting a treatment agent into a formation radially surrounding the wellbore, the treatment agent being effective to block water and/or gas from entering the wellbore from a first portion of the formation; a tunneling tool for creating a tunnel in the formation, the tunneling tool being effective to increase flow of hydrocarbon production fluid into the wellbore from a second portion of the formation;

wherein the treatment injection tool and the tunneling tool are incorporated into a single tool string;

one or more sensors operably associated with the treatment injection tool to detect at least one downhole parameter within the wellbore during injection of treatment agent;

a controller operably interconnected with the one or more sensors, the controller being programmed to determine wellbore fluid flow information based upon the detected at least one downhole parameter; and a valve which is operable to divert fluid flow between the treatment injection tool and the tunneling tool.

9. The arrangement of claim 8 wherein the one or more sensors include at least one sensor from the group consisting of: a pressure sensor, a temperature sensor, a gamma sensor, a flow measurement sensor and a camera.

10. The arrangement of claim 8 wherein the tunneling tool comprises an acid injection tunneling tool.

11. A method for treating a wellbore to reduce unwanted water or gas in hydrocarbon production fluid, the method comprising the steps of:

injecting a treatment agent into a portion of a formation surrounding the wellbore with a treatment injection tool, the treatment agent being effective to block flow of water or gas into the wellbore from the formation;

diverting fluid flow between the treatment injection tool and a tunneling tool; in a single bottom hole assembly by actuating a valve;

tunneling within another portion of the formation surrounding the wellbore with the tunneling tool, the tunneling being effective to increase flow of hydrocarbon production fluid into the wellbore from the formation;

monitoring at least one downhole parameter within the wellbore during the time the treatment agent is injected;

determining wellbore fluid flow information from the at least one downhole parameter being monitored; and altering the steps of injecting the treatment agent and/or tunneling in response to the determined wellbore fluid flow information.

12. The method of claim 11 wherein the step of monitoring at least one downhole parameter further comprises measuring pressure, temperature, gamma or fluid flow.

13. The method of claim 11 wherein the step of monitoring at least one downhole parameter further comprises obtaining one or more visual images of the wellbore with a camera.

14. The method of claim 11 wherein the step of injecting the treatment agent further comprises injecting said treatment agent into the formation with the treatment injection tool having an injection bottom hole assembly which has been run into the wellbore on a running string.

* * * * *